United States Patent [19]

Angelini et al.

[11] 4,404,157

[45] Sep. 13, 1983

[54] PROCESS FOR THE CONTINUOUS PRODUCTION OF VISCOSE RAYON YARNS HAVING HIGH DEGREE OF WHITENESS

[75] Inventors: Gianfranco Angelini, Buscate; Novello Leoncini, Limbiate; Bice Pallesi, Milan; Ugo Paoletti, Monza, all of Italy

[73] Assignee: SNIA VISCOSA Societa' Nazionale Industria Applicazioni Viscosa S.p.A., Milan, Italy

[21] Appl. No.: 274,369

[22] Filed: Jun. 17, 1981

[51] Int. Cl.[3] ..... D01F 11/02

[52] U.S. Cl. ..... 264/195; 264/196; 264/233

[58] Field of Search ..... 264/188, 233, 195, 196

[56] References Cited

U.S. PATENT DOCUMENTS

| | | | |
|---|---|---|---|
| 2,620,258 | 12/1952 | McLellan | 264/196 |
| 2,770,962 | 11/1956 | McLellan | 264/233 |
| 2,867,108 | 1/1959 | Severini | 264/233 |
| 3,077,374 | 2/1963 | Bates | 264/233 |
| 3,341,645 | 9/1967 | Horuchi et al. | 264/188 |
| 3,529,052 | 9/1970 | Carney et al. | 264/233 |

FOREIGN PATENT DOCUMENTS

| | | | |
|---|---|---|---|
| 41-17691 | 10/1966 | Japan | 264/188 |
| 44-22768 | 9/1969 | Japan | 264/188 |
| 47-42523 | 10/1972 | Japan | 264/188 |

*Primary Examiner*—Jay H. Woo

*Attorney, Agent, or Firm*—Wenderoth, Lind & Ponack

[57] ABSTRACT

Process for the continuous production of viscose rayon yarns having a high degree of whiteness, comprising extruding a viscose solution into a coagulating bath, drawing and coagulating the extruded filaments, advancing said filaments in a substantially helical path while they undergo all the treatments required for the production of the finished yarn, which process is characterized by, after the exit of the filaments from the spinning bath, completion of the coagulation to a coagulation index not higher than 1 and a treatment with water having a non-alkaline pH.

9 Claims, No Drawings

PROCESS FOR THE CONTINUOUS PRODUCTION OF VISCOSE RAYON YARNS HAVING HIGH DEGREE OF WHITENESS

BACKGROUND OF THE INVENTION

1. Field of the Invention

The present invention has as its object a process for the continuous production of viscose rayon yarns. More particularly it has as its object a simplified process for the continuous production of viscose rayon yarns having a high degree of whiteness (degree of white).

2. Prior Art

As is known, the continuous spinning of viscose rayon occurs through a rather complex series of treatments, which may advantageously take place while the yarn travels in a substantially helical path, viz. travels while it is wound onto rollers which are askew with respect to one another. A plurality of yarns may be concurrently treated on a single spinning machine, in this type of process, such as taught e.g. in a copending Italian application of the same applicant, No. 28324 A/78.

If the viscose rayon yarn which is obtained is to be used for textile purposes, it must have a certain degree of white, which can be measured by standard tests which will be discussed later. To this end the yarn, after having undergone coagulation in a coagulating bath, is typically subjected to setting, desulphurating, bleaching, finishing and various washings, besides a final drying. Desulphuration and bleaching are indispensable to obtain an adequate degree of white.

The art has sought for some time to improve this classic treatment, on the one hand by speeding it up, on the other by reducing the space take-up of the spinning machines, or in both ways. It has already been proposed to reduce the number of treatments by tolerating a lower degree of white, but the resulting yarn is only acceptable for some applications. The present invention solves the problem of simplifying the viscose rayon continuous spinning process, permitting accelerating it and/or reducing the space take-up of the spinning machines, without sacrificing an excellent degree of white, and, on the contrary, while obtaining a degree of white which is higher than that commonly accepted, and all this by extremely simple and economical means.

SUMMARY OF THE INVENTION

The process which is the object of the present invention comprises, in association, the following critical operations, which are carried out on a yarn that has already been partially coagulated and has been completely drawn (usually to a ratio of 1 to 1.57), which yarn preferably has already left the coagulating bath and has begun its substantially helical travel or other travel during which it is to undergo the final treatments:

1. completion of the coagulation, which at the exit from the coagulating bath corresponds to a coagulating index or "gamma index", as hereinafter defined, comprised between 15 and 25, until a final coagulation index not higher than 1 is obtained.

2. a treatment with water having a non alkaline pH—treatment which may be called "washing"—until the amounts of the following elements, which are retained on the yarn, have been reduced to the values hereinafter indicated: total sulphur, not more than 0.2%; sulphur bound as sulphides, not more than 0.02%; elemental sulphur, not more than 0.06% iron, not more than 40 ppm, preferably not more than 20 ppm; zinc, not more than 700 ppm, preferably not more than 500 ppm; lead, not more than 30 ppm, preferably not more than 10 ppm.

The completion of the coagulation may be effected in various ways:

(a) by the mere passing of time, without application of other reagents or liquors except those entrained by the yarn;

(b) by an acid treatment, e.g. in a sulphuric acid bath, which may contain zinc and/or sodium sulphates, e.g. at temperatures between 50° C. and 100° C.;

(c) by a succession of the aforesaid treatments—(a) and (b)—in two successive stages.

Other substitute or additional treatments may be carried out, such as treatments by means of baths having different acidities, the only essential condition being that the aforesaid coagulation index be attained.

After the treatment with water having a non alkaline pH, the yarn is such that, once it has been subjected to drying and possibly finishing, it will have a degree of white not lower than 45.

The degree of white (W) is measured by means of the Hunterlab apparatus by the Hunter method.

The coagulation index "$\gamma$" is defined and calculated as the number of moles of $CS_2$ per 100 anhydroglucosidic groups of the cellulose. A yarn having an index $\gamma$ which lies between 0 and 1 is considered completely coagulated.

The process according to the invention therefore produces a finished yarn having a high degree of white, through the following processing stages: partial coagulation and drawing, completion of the coagulation, washing under the aforesaid conditions, drying, possibly finishing.

Other treatments for improving the degree of white are therefore not necessary, and actually the degree of white cannot be further improved in a significant manner. However the scope of the invention will not be exceeded if other auxiliary treatments are added to the aforesaid treatments.

The process is carried out preferably with spinning speeds, viz. yarn take-up speeds, not lower than 90 m/min.

Preferably the aforesaid washing is carried out at temperatures between 20° and 30° C. and for a period of time between 25 and 40 seconds. The completion of the coagulation is preferably effected in a period of time between 15 and 40 seconds.

Another aspect of the invention consists in the chemical composition of the wash water which permits washing under the specified conditions and with the results that have been set forth, and in the way of obtaining this wash water.

The water which is used should have a pH between 4.0 and 5.5.

Further, it should be free from cations in amounts higher than the following amounts: $Ca^{2+}$ 1.5 mg/l and $Mg^{2+}$ 1.0 mg/l.

DETAILED DESCRIPTION OF THE PREFERRED EMBODIMENTS

It has been found that a water having these characteristics, whenever it is not already available, which occurs only rarely, may be obtained by treating the water available from the industrial distribution network with weakly acid ion exchange resins. The treatment with resins is continued until the pH of the water reaches values between 4 and 5.5, preferably between 4 and 4.7.

An example of the invention will now be described for purely illustrative purposes.

A cellulose paste intended for dissolution, having a α-cellulose content of 92%, is mercerized in NaOH at 18% and is squeezed to a squeezing ratio of 1:2.8, so as to obtain an alkali cellulose having the following composition:

Cellulose: 32%

Total alkalinity expressed as NaOH: 15.7%

The alkali cellulose thus obtained is disintegrated and ripened until a polymerization degree of 350 of the cellulose therein contained is obtained. When the ripening has ended, the alkali cellulose is sulphurated with 30% of $CS_2$, based on the cellulose contained therein. The xantate thus prepared is dissolved in a diluted NaOH solution so as to obtain a viscose having the following composition:

Cellulose: 8%

Total alkalinity expressed as NaOH: 6.0%

Total sulphur: 2%.

The viscose thus obtained is spun so as to produce a yarn having a count of 133 dtex, in a spinning bath at 45° C., having the following composition:

Sulphuric acid: 140 g/l

Zinc sulphate: 10 g/l

Sodium sulphate: 250 g/l.

The spinning process is carried into practice by means of a glass pipe within which the coagulated yarn travels in the same direction as the coagulating bath. The yarn is withdrawn from the bath and at the stage has a γ index of 18, and in the withdrawal stage it is drawn by friction against yarn guides to a ratio 1 to 1.5. At this point the yarn starts to travel in a substantially helical path on a device as described in the copending Italian patent application No. 22076 A/78 filed on Apr. 7, 1978, which essentially consists of a support and advancing structure, on which the yarn undergoes a series of chemical and physical treatments.

In the example which has been described, the yarn undergoes, in a first stage, a spontaneous synaeresis, and is then treated with a setting bath constituted by a 15 g/l $H_2SO_4$ solution at 90° C., whereafter it is washed with water having a pH of 4.5 and a content of Ca and Mg ions respectively of 1.0 and 0.5 mg/l, is then treated with an emulsion of mineral oil, and is finally dryed and taken up on a ring twister.

The yarn which is obtained has the following mechanical characteristics:

Tenacity in the conditioned state—18 cN/tex

Elongation in the conditioned state—18%

Tenacity in the wet state—8.3 cN/tex

Elongation in the wet state—31%

The characteristics and the advantages of the invention will be better evidenced by Table 1, in which analytical data of yarns are tabulated. To show the criticality of the combination of operations according to the invention, comparison data have been obtained not from yarns treated with conventional processes—which require a greater number of operations and much longer times, therefore lower spinning speeds—but with yarns which have all undergone a partial coagulation in the bath and a completion of the coagulation, but have not undergone washing under the preferred conditions of the present invention. In the first column of the table the elements and the quantities which have been determined are indicated. Column 2 illustrates the analysis of the yarn after the completion of the coagulation. It is seen that the degree of white is 30, which if the normal washing and finishing treatments were carried out, would be the degree of white obtained on the finished yarn, requiring a separate bleaching operation in order to increase it.

Column 3 illustrates the characteristics of the yarn which after completion of the coagulation has been washed with distilled water having a pH of 7.0. It is seen that the degree of white has been improved somewhat, but still to an insufficient degree, in spite of the use of distilled water which is economically prohibitive.

Column 4 illustrates the characteristics of the yarn which, after the completion of the coagulation, has been treated with dehardened water having a pH of 8.2, and indicates the criticality of the pH values set forth according to the invention.

TABLE 1

| 1 | 2 | 3 | 4 | 5 | 6 |
|---|---|---|---|---|---|
| Degree of white | 30 | 40 | 35 | 49 | 52 |
| Total sulphur % | 0.31 | 0.18 | 0.24 | 0.19 | 0.18 |
| Elementary Sulphur % | 0.09 | 0.08 | 0.08 | 0.05 | 0.05 |
| Sulphur from sulphides % | 0.04 | 0.03 | 0.04 | 0.02 | 0.02 |
| Sulphur from sulphates % | 0.18 | 0.07 | 0.12 | 0.12 | 0.11 |
| Ashes % | 0.50 | 0.07 | 0.36 | 0.09 | 0.09 |
| Zn, ppm | 850 | 240 | 300 | 280 | 260 |
| Fe, ppm | 25 | 7 | 10 | 8 | 5 |
| Pb, ppm | 35 | 30 | 30 | 25 | 30 |

Finally columns 5 and 6 show the data of two yarns treated by the process according to the invention, with water treated with weakly acid exchange resin having a pH of 4.6. It is seen that the degree of white is in both cases very high, respectively 49 and 52. The comparison of the analytical data leads one to believe that the determining factor is the reduction of the sulphur from sulphides. Actually said reduction is accompanied by an improvement of the degree of white, whereas the other analytical data do not seem to be correlated with the degree of white. However, the Applicants do not wish to be bound to any interpretation of the phenomenon on which the invention is based, and do not go beyond the experimental finding that a high degree of white is invariably obtained with a simplified, more rapid and more economical process, whenever the conditions of the invention are observed.

To show the advantages of the invention, a scheme is shown hereinafter in which the process according to the invention and the traditional process are compared, the starting viscose being the same and the final degree of white being the same. It is seen that the traditional process requires one to handle, separate and recover a higher number of treatment liquors, which implies an economical burden with respect to the process according to the invention.

In the following scheme treatments and characteristics of the yarn have been reported according to the traditional process (Column A) and according to the present invention (Column B).

| A | B |
|---|---|
| POSTCOAGULATION | POSTCOAGULATION |
| FIRST SETTING IN A BATH AT 76° C. CONSTITUTED BY $H_2O$ AND $H_2SO_4$ AT THE CONCENTRATION OF 50 g/l. | |
| SECOND SETTING AND DESULPHURATION IN A BATH AT 62° C. CONSTITUTED BY $H_2O$ + $H_2SO_4$ AT THE CONCENTRATION OF 25 g/l. | ACID WASHING IN A BATH AT 38° C. CONSTITUTED BY $H_2O$ + $H_2SO_4$ AT THE CONCENTRATION OF 3.5/4.0 g/l. |
| WASHING IN DEHARDENED $H_2O$ | |
| BLEACHING IN A BATH CONSTITUTED BY $H_2O$ + NaOCl AT THE CONCENTRATION OF 1.2 g/l. | WASHING IN $H_2O$ PURIFIED WITH WEAKLY ACID ION EXCHANGE RESIN HAVING pH 4.0/5.5 |
| WASHING IN DEHARDENED $H_2O$ | |
| FINISHING - DRYING - TAKE-UP | FINISHING - DRYING - TAKE-UP |

| | A | B |
|---|---|---|
| Degree of white | 49 | 49 |
| Total sulphur % | 0.29 | 0.18 |
| Elemental sulphur % | 0.15 | 0.06 |
| Sulphur from sulphides % | 0.02 | 0.02 |
| Sulphur from sulphates % | 0.12 | 0.10 |
| Ashes % | 0.6 | 0.09 |
| Zn ppm | 330 | 280 |
| Fe ppm | 11 | 20 |
| Pb ppm | 15 | 19 |

We claim:

1. In a process for the continuous production of viscose rayon yarns, which comprises extruding a viscose solution into a coagulating bath, drawing and coagulating the resultant extruded filaments in said bath, and advancing said filaments in a substantially helical path while said filaments undergo treatments required for the production of a finished yarn, the improvement wherein, after said filaments are withdrawn from said coagulating bath, said filaments are further coagulated until a coagulation index not higher than 1 is attained, and said filaments having a coagulation index not higher than 1 are treated with water having a pH between 4.0 and 5.5, a $Ca^{2+}$ content not higher than 1.5 mg/l, and a $Mg^{2+}$ content not higher than 1.0 mg/l, until the content of the following elements in the yarn has been reduced to values not higher than indicated: total sulphur 0.2%, sulphur bound as sulphides 0.02%, elemental sulphur 0.06%, iron 40 ppm, zinc 700 ppm, and lead 30 ppm.

2. Process according to claim 1, wherein the filaments have a coagulation index between 15 and 25 at the exit from the bath.

3. Process according to claim 1, wherein the further coagulation occurs, at least in part, by the mere passage of time without the application of other processing liquors except those entrained by the yarn.

4. Process according to claim 1, wherein the further coagulation occurs, at least in part, by treatment with an acid bath.

5. Process according to claim 4, wherein the acid bath is a solution of sulphuric acid, and the treatment with the acid bath occurs at a temperature of 50°–100° C.

6. Process according to claim 1, wherein the treatment with the water is continued until a yarn is obtained which, after drying and finishing, has a degree of whiteness not lower than 45.

7. Process according to claim 1, wherein the treatment with the water is carried out at a temperature between 20° C. and 30° C. for a period of time between 25 and 40 seconds.

8. Process according to claim 1, wherein the water is purified with weakly acid ion exchange resin.

9. Process according to claim 1, wherein the spinning is carried out with yarn take-up speeds not lower than 90 m/min.

* * * * *